US006364182B1

(12) United States Patent
Hansen

(10) Patent No.: US 6,364,182 B1
(45) **Date of Patent: *Apr. 2, 2002**

(54) HOLSTER ASSEMBLY WITH DISPOSABLE BLADE WELL

(76) Inventor: Mary Kay Hansen, 586 Blackhawk Trail, Loveland, OH (US) 45140

( * ) Notice: Subject to any disclaimer, the term of this patent is extended or adjusted under 35 U.S.C. 154(b) by 0 days.

This patent is subject to a terminal disclaimer.

(21) Appl. No.: 09/612,030

(22) Filed: Jul. 7, 2000

Related U.S. Application Data

(63) Continuation-in-part of application No. 09/332,478, filed on Jun. 14, 1999, now Pat. No. 6,105,838, which is a continuation-in-part of application No. 09/057,744, filed on Apr. 9, 1998, now Pat. No. 6,000,590.

(51) Int. Cl.[7] ..... A45F 5/00

(52) U.S. Cl. ..... 224/232; 224/679; 224/680; 224/245; 224/904; 224/674; 224/666; 224/672; 30/161; 206/359

(58) Field of Search ..... 224/232, 233, 224/234, 678, 679, 680, 681, 242, 245, 673, 674, 671, 672, 666, 904; 206/352, 359; 30/124, 151, 162; 220/23.87, 528

(56) References Cited

U.S. PATENT DOCUMENTS 590,212 A 9/1897 Daesch
831,771 A 9/1906 Bragg (List continued on next page.)

FOREIGN PATENT DOCUMENTS

DE 3534627 4/1987
DE 4321520 1/1995
EP 0400800 5/1990
EP 0395338 10/1990
EP 0700757 3/1997
IT 380999 6/1940

OTHER PUBLICATIONS

OLFA Corporation, Packaging and photo, OLFA Product, Model AB–10B (Date Unknown).
Red Devil, Inc., Breakaway Blade Safety Dispenser, Packaging and photo, Red Devil (Date Unknown).
Red Devil, Inc., Automatic Razor Knife, Packaging and photos, Red Devil (Date Unknown).
Stanley Tools, Quick–Point Knife, Packaging and photos, Stanley Tools Product, Copyright 1995.
Warner Manufacturing Co., Pro/Snap–Blade Knife, Packaging and photos, Warner Manufacturing Co. (Date Unknown).
The C–Thru Ruler Company, Utility Knife, Packaging, The C–Thru Ruler Company (Date Unknown).
Sherwin–Williams Co., Snap–Off Knife, Packaging and photo (Date Unknown).
Greystone, Retractable Utility Knife and Holder, Packaging and photos, Greystone Product (Date Unknown).
Do It, Snap Blade Knife, Packaging (Date Unknown).
More Blades, Catalog Entry Listing Products and Prices (Date and Source Unknown).
Hyde Tools, Snap Off Blades, Packaging and photo (Date Unknown).
American Safety Razor Co., Breakaway Knife, Packaging and photo, Copyright 1994.

*Primary Examiner*—Gregory M. Vidovich
(74) *Attorney, Agent, or Firm*—Wood, Herron & Evans L.L.P.

(57) ABSTRACT

A holster assembly for use with a hand-held utility knife having a segmented blade. The holster assembly comprises a plastic holster having a generally hollow interior and a blade well located inside the hollow interior of the holster. The blade well has at least one slot therethrough. By simply twisting the knife, a user may break off the endmost blade segment exposing a fresh cutting edge. The used blade segments are collected inside the blade well.

14 Claims, 2 Drawing Sheets

U.S. PATENT DOCUMENTS

| | | | | | |
|---|---|---|---|---|---|
| 1,910,374 | A | | 5/1933 | Williams | |
| 2,054,080 | A | | 9/1936 | Haynes | |
| 3,857,176 | A | | 12/1974 | Quenot | |
| 4,063,356 | A | | 12/1977 | Hepworth | |
| 4,103,421 | A | | 8/1978 | Quenot | |
| 4,114,780 | A | | 9/1978 | Sharon | |
| 4,226,020 | A | | 10/1980 | Quenot et al. | |
| 4,395,807 | A | | 8/1983 | Eldridge, Jr. et al. | |
| 4,759,441 | A | | 7/1988 | Leurek | |
| 5,009,222 | A | | 4/1991 | Her | |
| 5,014,429 | A | | 5/1991 | McNamara | |
| 5,093,993 | A | | 3/1992 | Nishiyama | |
| 5,186,326 | A | | 2/1993 | Peckels et al. | |
| 5,341,975 | A | * | 8/1994 | Marinescu | 224/904 X |
| 5,388,741 | A | | 2/1995 | Hillinger | |
| 5,505,356 | A | | 4/1996 | Noriega | |
| 5,507,762 | A | | 4/1996 | Abidin et al. | |
| 5,568,888 | A | | 10/1996 | Seber | |
| 5,653,337 | A | | 8/1997 | Cirigliano | |
| 6,000,590 | A | | 12/1999 | Allen | |
| 6,105,838 | A | * | 8/2000 | Hansen | 224/232 |

* cited by examiner

HOLSTER ASSEMBLY WITH DISPOSABLE BLADE WELL

CROSS REFERENCE TO RELATED APPLICATIONS

This patent application is a continuation-in-part application of U.S. patent application Ser. No. 09/332,478 U.S. Pat. No. 6,105,838 filed Jun. 14, 1999 entitled Holster and Blade Well which is fully incorporated by reference herein. Ser. No. 09/332,478 is a continuation-in-part application of U.S. patent application Ser. No. 09/057,744, now U.S. Pat. No. 6,000,590 filed Apr. 9, 1998 which is fully incorporated by reference herein.

FIELD OF INVENTION

This invention relates to the storage of utility knives having segmented disposable blades, and more particularly to an apparatus for storing and holding such a utility knife along with used blade segments resulting from use of the knife.

BACKGROUND OF THE INVENTION

Utility knives adapted to hold segmented blades are known. Such knives are commonly used to cut wallpaper, cardboard or other types of similar products. As the cutting edge of the endmost segment of the blade becomes dull due to repeated use, the endmost blade segment may be snapped off exposing a fresh blade segment having a fresh cutting edge. This process may be repeated until all of the blade segments have been used. The remainder of the blade may be removed from the knife and a replacement blade having multiple unused segments may then be inserted into the knife. This process may be repeated as long as replacement blades are available.

Most of these hand-held utility knives are adapted to retract the segmented blade so that the cutting edge of the endmost segment may be withdrawn into the interior of the knife when the knife is not being used. A knife capable of retracting the blade is generally safer than a knife in which the blade is not retractable. U.S. Pat. Nos. 4,103,421 and 4,226,020 disclose knives having a cutting blade which may be fully or partially retracted and held in such a position.

One difficulty with using a knife with a segmented blade is that with repeated use, the cutting edge of the endmost blade segment will dull. The endmost blade segment must then be broken off from the remainder of the blade. Usually, some sort of tool is necessary to grasp or engage the endmost used blade segment and break it off from the remainder of the blade. Once the endmost blade segment is broken off, it must be discarded safely. Several knives such as the one disclosed in U.S. Pat. No. 4,063,356 have been equipped with a device, often called an end cap, which may be removed from one end of the knife and used to snap off the endmost segment of the blade. Such an end cap usually has a slot therein which is adapted to receive the endmost blade segment. One difficulty with using an end cap to snap off endmost blade segments is that once the endmost blade segment has been broken off from the remainder of the blade, there is no place for the used blade segment to be placed or stored safely. Consequently, the used blade segment may drop onto the floor where it may be picked up by a child or stepped on or otherwise cause harm to someone in the vicinity. Only if the user of such a hand knife is able to maintain pressure on the sides of the end cap while the endmost blade segment is located in the slot of the end cap will the used blade segment not fall away from the end cap onto the floor. If the user is able to hold the used blade segment with the end cap, the user may walk over to a trash can and properly dispose of the used blade segment. However, often the user is on a ladder or nowhere near a trash receptacle. Therefore, this method of breaking off and disposing used blade segments is not always practical. In addition, it is time consuming and requires a great deal of effort.

Another difficulty with using an end cap to break off an endmost blade segment is that often the user's hands are wet or dirty so, consequently, when trying to snap off the endmost blade segment with the end cap, the user's hands may slip and result in a skin cut. Because the slot in the end cap is relatively narrow, it is difficult to properly line up the slot in the end cap with the endmost blade segment. The user may miss the slot in the end cap, causing the cutting edge of the endmost blade segment to cut the user.

Knives have been developed which are adapted to store used blade segments temporarily. Examples of such knives are disclosed in U.S. Pat. Nos. 5,093,993 and 5,014,429. However, these knives are adapted to house or store a limited number of used blade segments. Additionally, proper disposal of these used blade segments is difficult once the storage space of the knife has been filled.

Another difficulty with using an end cap of a hand knife to break off blade segments is that two hands are required to remove the end cap from one end of the knife and place it over the endmost blade segment at the other end of the knife in order to properly snap off the endmost blade segment. Often when a user is on a ladder or in another such location, two hands are not available because the user must use one hand to hold himself or herself in place for safety purposes.

Therefore, it has been one objective of the present invention to provide a mechanism for holding and storing a utility knife and collecting used blade segments for proper disposal.

It has been a further objective of the present invention to provide an apparatus which is capable of being used with a utility knife having a segmented blade in which the endmost blade segment may be quickly and easily snapped off by the user with the use of only one hand.

It has been a further objective of the present invention to provide an apparatus adapted to store both a hand-held utility knife and a plurality of used blade segments which may be worn by a user comfortably.

SUMMARY OF THE INVENTION

The invention of this application which accomplishes these objectives comprises a holster assembly for use with a hand held utility knife adapted to hold a segmented blade. Such utility knives take many different forms and are the subject of numerous patents. The invention of this application may be used with many different hand held utility knives. Therefore, the utility knife and the segmented blade form no part of the present invention.

The holster assembly of the present invention is adapted to receive and hold a utility knife having a segmented blade and a disposable blade well. The holster assembly comprises a plastic holster having multiple wall portions and a bottom portion, the wall and bottom portions defining a hollow interior adapted to receive and store a utility knife having a segmented blade and a disposable blade well. The holster has an open top so that the utility knife may be removed and used without disturbing the blade well. Similarly, the blade well may be removed without disturbing the utility knife.

The holster preferably has a clip secured to a rear wall portion of the holster, enabling the user to secure the holster onto his or her belt, pants or a pocket where it is in a user-friendly position and will not interfere with the ability of the user to work. Other securing mechanisms not specifically illustrated and described such as belt loops may be used as well to secure the holster to the user.

The disposable blade well is removably located inside the generally hollow interior of the holster. The blade well has a generally hollow interior adapted to collect and receive used blade segments. The blade well has a first slot therethrough whereby an endmost segment of the knife blade may be placed into the slot and the knife twisted in order to break off the endmost segment of the knife blade, the endmost segment falling inside the blade well.

Consequently, a fresh, sharp edge of the segmented blade is exposed for use. Upon repetition of this process, multiple used blade segments are collected inside the hollow interior of the blade well. Once the hollow interior of the blade well is sufficiently full, the blade well may be discarded and replaced with an empty, new disposable blade well.

The blade well has a finger loop secured to the top of the blade well whereby a user may lift the blade well away from the holster by inserting a finger into the finger loop and pulling the blade well upwardly. In this manner, the blade well, once full of used blade segments, may be removed and discarded. An empty blade well may then be inserted into the hollow interior of the holster and the process repeated.

The blade well also has a second slot formed through the top of the blade well. This second slot enables a user to discard the end piece of a segmented knife blade (the piece left over after all the segmented pieces have been used) by passing the end piece through the second slot and into the hollow interior of the blade well. Although the second slot is preferably formed in the top of the blade well, it may be located at any other location. Similarly, the first slot may be located anywhere on the blade well, although it is illustrated in one specific location.

The blade well has a storage compartment integrally formed therein. The blade storage compartment is adapted to store additional unused segmented blades. Although the blade storage compartment is preferably integrally formed with the blade well, it may be separately formed and attached to the blade well. The storage compartment functions to safely store additional segmented blades which may be inserted into the utility knife once the blade in the knife is worn out due to use and all of the segments broken off. The storage compartment has a cap hingedly connected to the blade storage compartment which may be lifted in order to remove one or more unused blades from the blade storage compartment.

The blade storage compartment is vertically oriented and sized so as to engage a receptacle integrally formed in the holster. The engagement of the blade storage compartment of the blade well with the receptacle of the holster functions to inhibit lateral movement of the blade well inside the generally hollow interior of the holster yet permits the blade well to be lifted out of the hollow interior of the holster.

The holster assembly of the present invention may be worn by a user in a position where it will not interfere with the user's ability to work with a hand-held utility knife. In addition, the holster assembly provides a storage device for collecting and storing used blade segments. A slot in the blade well enables a user to engage the endmost blade segment of the utility knife with the slot and simply twist the utility knife in order to break off the endmost blade segment. This is a relatively easy method of breaking off the endmost used blade segment. The user does not have to use two hands to break off an endmost blade segment. These and other objects and advantage of the present invention will be more readily apparent from the following description of the drawings.

DETAILED DESCRIPTION OF THE DRAWINGS

Figure 1:
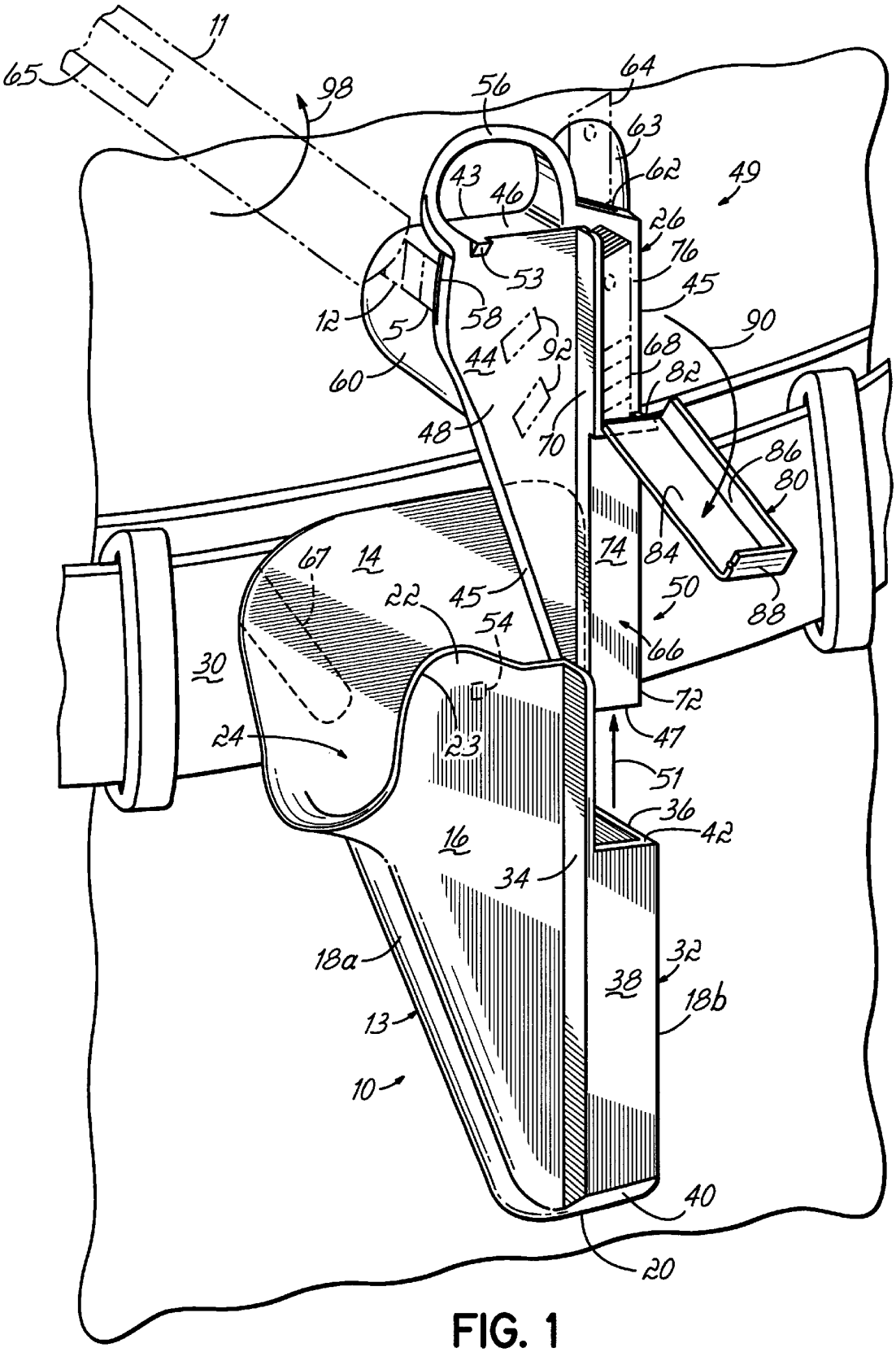
FIG. 1 is a perspective view of the holster assembly of the present invention secured to a user's belt, the blade well being illustrated above the holster.

Referring to the drawings and particularly to FIG. 1, there is illustrated a holster assembly 10 to be used with a hand-held utility knife 11 adapted to hold and receive a segmented blade 12. Such utility knives are common and typically used to cut wall paper, carpet and other similar items. The invention of this application may be used with any type of utility knife adapted to hold and receive a segmented blade including utility knifes having clips for securing the utility knife to one's clothing.

Figure 1A:
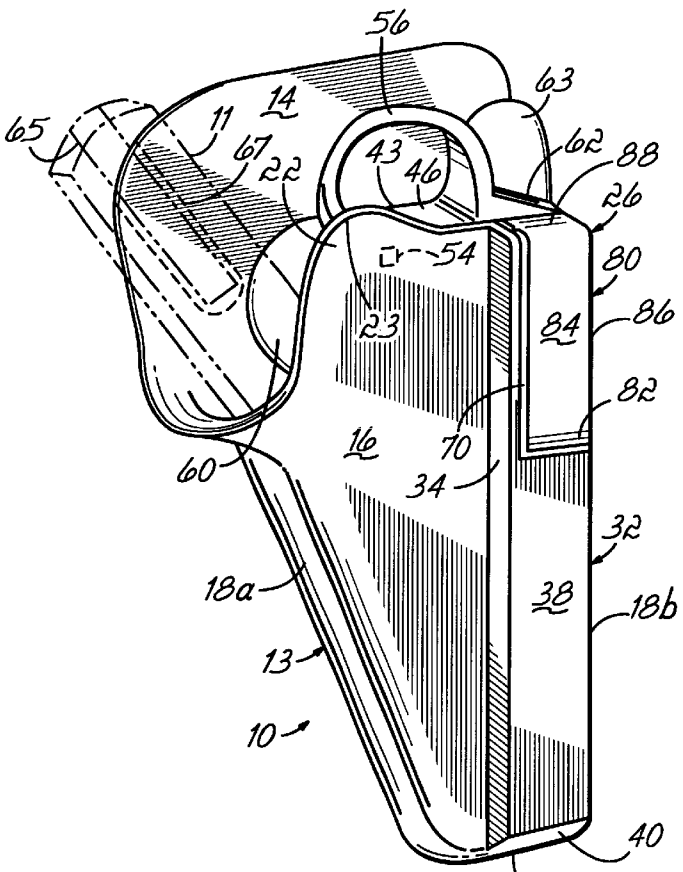
FIG. 1A is a perspective view of the holster of the holster assembly of FIG. 1 with the blade well and a utility knife being located inside the generally hollow interior of the holster.

The holster assembly 10 comprises a holster 13 and blade well 26. The holster 13 and blade well 26 are preferably made of plastic but may alternatively be made of other materials. The holster 13 is preferably made of one piece of molded plastic but may be alternatively made of multiple pieces. As best illustrated in FIG. 1, the holster 13 has a generally planar rear wall portion 14, a front wall portion 16 and two side wall portions 18*a*, 18*b*. The side wall portions 18*a*, 18*b* and front wall portion 16 are connected with a bottom portion 20. An index finger grip 22 forms part of the front wall portion 16 of the holster 13. The index finger grip 22 protects a user's index finger when snapping off an endmost blade segment. The index finger grip 22 has an arcuate upper edge 23. The front, rear and side wall portions 16, 14, 18*a*, 18*b* and bottom portion 20 define a hollow interior 24 or cavity of the holster. The hollow interior 24 of the holster is adapted to receive and hold the utility knife 11 and the blade well 26 as seen in FIG. 1A.

Figure 2:
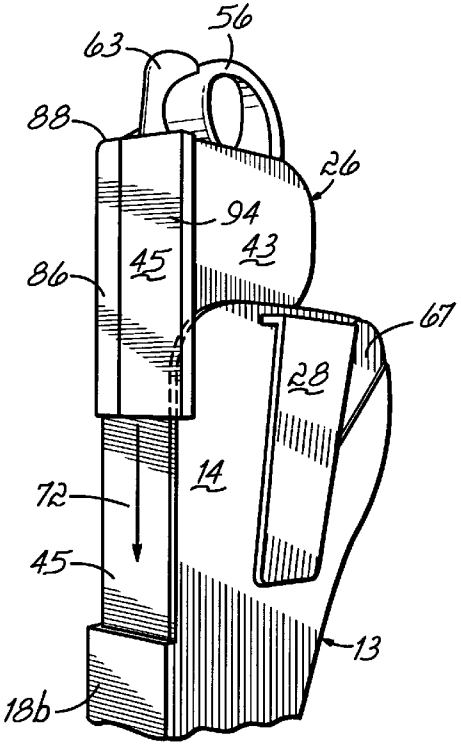
FIG. 2 is a perspective view of a portion of the holster assembly of FIG. 1 with the blade well of the holster assembly being inserted into the holster.

As best seen in FIG. 2, the holster 13 has a resilient clip 28 secured to the rear wall portion 14 of the holster 13 which is adapted to secure the holster 13 to a user. As seen in FIG. 1, the clip 28 is adapted to engage a user's belt 30. The clip 28 is preferably used in order to quickly and easily secure the holster assembly 10 to the user. The clip 28 may additionally be used to secure the holster to a user's pocket, to the top of a user's pants, to a tool belt or to any other item secured to the user.

The front wall portion 16 of the holster 13 is configured so as to form a receptacle 32 extending forwardly from the remainder of the front wall portion 16 of the holster. The receptacle 32 is vertically oriented and integrally formed with the holster as illustrated in FIGS. 1 and 1A. The receptacle 32 is defined by a sidewall 34, a sidewall 36, a front wall 38 and a bottom portion 40. The receptacle 32 has an upper edge 42. Although one configuration of receptacle 32 is illustrated, the receptacle may assume numerous other configurations.

The rear wall portion 14 of the holster 13 has a recessed portion 67 adapted to receive and retain the utility knife 11. Although any type of utility knife adapted to hold and receive a segmented blade may be used in accordance with the present invention, FIG. 1A illustrates a particular configuration of utility knife 11. The utility knife 11 has a clip 65 which may be used to secure the utility knife 11 to the rear wall portion 14 of the holster 13. The recessed portion 67 is thinner than the remainder of the rear wall portion 14 of the holster 13. The clip 65 of the utility knife 11 fits over the recessed portion 67 of the rear wall portion 14 of the holster 13 and releasably secures the utility knife 11 to the rear wall portion 14 of the holster 13.

The blade well 26 of the holster assembly 10 is adapted to be removably located inside the hollow interior 24 of the holster 13. FIG. 1A illustrates the blade well 26 located inside the generally hollow interior 24 of the holster 13 while FIG. 1 illustrates the blade well 26 being lowered into the generally hollow interior 24 of the holster 13. Inside the generally hollow interior 24 of the holster 13, the blade well 26 preferably extends upwardly from the bottom portion 20 of the holster 13 to an upper edge 17 of the front wall portion 16 of the holster 13.

As best seen in FIGS. 1 and 2, the blade well 26 has a rear wall 43, a front wall 44 and a pair of sidewalls 45, a top 46 and a bottom 47 which define a hollow interior or storage area 48. The hollow interior or storage area 48 functions to store used blade segments 92 (see FIG. 1). The blade well 26 is preferably configured such that it has a generally rectangular upper portion 49 and a tapered lower portion 50. The blade well 26 is preferably a one piece molded unit. However, the blade well 26 may be made of multiple pieces and may be made of any material.

As seen in FIG. 1, the blade well 26 also has a projection 53 formed therein which is adapted to engage a recess 54 formed in the front wall portion 16 of the holster 13. When the blade well 26 is placed inside the generally hollow interior 24 of the holster 13, the projection 53 maintains the blade well 26 in place and helps to prevent movement of the blade well 26 inside the generally hollow interior 24 of the holster 13.

The blade well 26 preferably has a finger loop 56 which extends upwardly from the top 46 of the blade well 26 and enables a user to put his or her finger in the finger loop 56 and lift upwardly in order to remove the blade well 26 from inside the generally hollow interior 24 of the holster 13. By pulling upwardly on the finger loop 56 of the blade well 26, a user may move the blade well from a stored position illustrated in FIG.1 A to a separated position illustrated in FIG. 1 (see arrow 51 of FIG. 1).

As illustrated in FIG. 1, the blade well 26 has a first slot 58 therethrough. The first slot 58 communicates with the hollow interior 48 of the blade well 26 and is sized so as to enable an endmost segment 5 of a segmented blade 12 to pass therethrough into the generally hollow interior 48 of the blade well 26 (see FIG. 1). The first slot 58 is proximate a first rear wall extension 60 which extends outwardly from the rear wall 43 of the blade well 26. The first rear wall extension 60 functions to protect the user from getting cut when snapping off an endmost blade segment and also functions to help guide the endmost blade segment 5 into the first slot 58. The first slot 58 is placed in such a position on the blade well 26 so as to enable a user to selectively place an endmost segment of a knife blade into the first slot 58, twist the knife 11 and consequently break off the endmost segment of the blade 5, the endmost segment 5 falling into the interior 48 of the blade well 26.

As seen in FIG. 1, the blade well 26 also has a second slot 62 therethrough. More specifically the second slot 62 passes through the top 46 of the blade well 26. The second slot 62 is adapted to receive an end piece 64 of a used blade (see FIG. 1). The end piece 64 is the piece that is left over after all the segments have been broken off a segmented blade. The second slot 62 communicates with the hollow interior 48 of the blade well 26 so that an end piece 64 may be passed through the second slot 62 and into the hollow interior 48 of the blade well 26.

The second slot 62 is proximate a second rear wall extension 63 which extends outwardly and upwardly from the rear wall 43 of the blade well 26. The second rear wall extension 63 functions to protect the user from getting cut when placing an end piece 64 into the hollow interior of the blade well 26 and also functions to help guide the end piece 64 into the second slot 62.

As seen in FIG. 1, the blade well 26 also has a blade storage compartment 66 which is adapted to hold a plurality of unused blades 68 (see FIG. 1). The blade storage compartment 66 is defined by an inside sidewall 70, an outside sidewall 72, a front wall 74 and a rear wall 76. The blade storage compartment 66 is preferably integrally formed with the blade well 26 but may be a separate component.

The blade well 26 also has a cap 80 hingedly connected to the blade storage compartment 66 with hinge 82 (see FIG. 1). One type of hinge which may be used is considered a living hinge. The hinged cap 80 comprises a front wall portion 84, an outer wall portion 86 and a top portion 88. In order to pull out a replacement blade 68 when the blade of a utility knife is entirely used or spent, a user simply pulls the cap 80 forwardly in the direction of arrow 90 in order to expose the unused blades 68. One of the unused blades 68 is then pulled out of the blade storage compartment 66 and placed in a utility knife so that the utility knife has a fresh blade. This process is repeated as long as there are available unused blades 68 in the blade storage compartment 66.

Once broken off using the first slot 58, the used blade segments 92 collect inside the hollow interior 48 of the blade well 26. When the hollow interior 48 of the blade well 26 becomes full, the user must discard the blade well 26 thereby moving the blade well 26 in the direction of arrow 51. The user removes the blade well 26 from the holster 13 by pulling upwardly on the finger loop 56 of the blade well 26. In this manner, unless the user turns the blade well 26 upside down, the blade well 26 will collect multiple used blade segments 92 preventing them from falling on the floor or otherwise being lost such that they could cause injury to someone in the vicinity.

Referring now to FIG. 2, the blade well 26 is further prevented from moving inside the hollow interior 24 of the holster 13 by a retention bracket 94 which extends rearwardly from the side 45 of the blade well 26. The retention bracket 94 engages the rear wall portion 14 of the holster 13 in the manner illustrated in FIG. 2. This engagement prevents the blade well 26 from laterally moving inside the hollow interior 24 of the holster 13 and ensures that there is adequate room for the user to place a utility knife 11 inside the hollow interior 24 of the holster 13.

Figure 3:
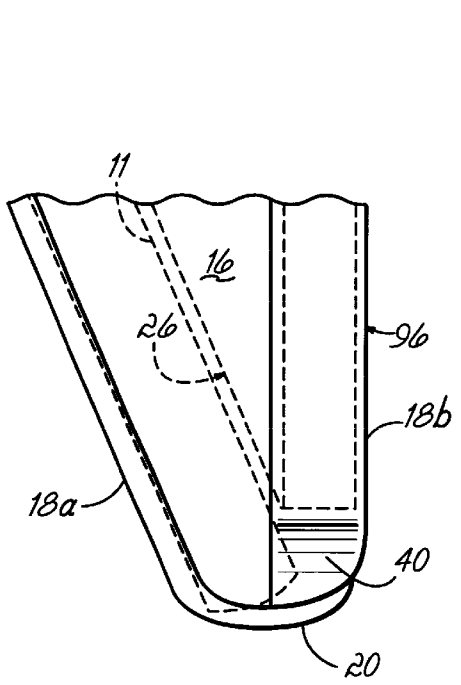
FIG. 3 is a side elevational view of a portion of the holster assembly of FIG. 1.

Referring to FIG. 3, there is illustrated a lower portion 96 of the holster with the blade well 26 and a utility knife 11 inserted therein. FIG. 3 specifically illustrates the location of the blade well 26 such that there is adequate room for the utility knife 11 inside the generally hollow interior 24 of the holster 13.

Referring now to FIG. 1, the method by which the endmost blade segment 5 of a utility knife blade 12 is broken off using the first slot 58 of the blade well 26 will be described in detail.

Referring to FIG. 1, the endmost blade segment 5 of blade 12 is brought into engagement with the first slot 58. The endmost blade segment 5 then passes partially through the slot 58. The knife 11 is then twisted (see arrow 98) in order to break off the endmost blade segment 5. The endmost blade segment 5 then falls downwardly inside the hollow interior 48 of the blade well 26 exposing a new unused cutting surface of the blade.

Although the holster assembly of the present invention has been described as being secured to a user, the holster assembly may be adapted to be mounted on a ladder or to a desk or other fixture. Additionally, the holster assembly may be adapted for use by either a left or right handed individual, Thus, the present invention enables a user to snap off an endmost blade segment of a hand-held utility knife using only one hand more safely and efficiently than has been heretofore possible. Further, the used blade segments may be collected and properly discarded without the risk of used blade segments falling on the floor or otherwise being misplaced to locations in which they may cause harm or injury.

While I have described one preferred embodiment of the present invention, persons skilled in the art will appreciate changes and modifications which may be made without departing from the spirit of this invention. For example, a finger grip may be provided on the blade well. Therefore, I do not intend to be limited except by the scope of the following claims.

What is claimed is:

1. A holster assembly for use with a utility knife having a segmented blade, said holster assembly comprising:

a holster having an open top, a generally hollow interior adapted to receive and hold said utility knife and a receptacle, and a blade well removably located inside said generally hollow interior of said holster, said blade well having a first slot therethrough whereby an endmost segment of the knife blade is selectively placed into the first slot and the knife twisted in order to break off the endmost segment of the knife blade, the endmost segment falling inside said blade well, wherein said blade well has a blade storage compartment separate from the inside of the blade well adapted to store additional segmented blades, said blade storage compartment being complementarily configured with said receptacle.

2. The holster assembly of claim 1 wherein said blade well has a top, said top of said blade well having a second slot therethrough.

3. The holster assembly of claim 1 wherein said blade well has a finger loop.

4. The holster assembly of claim 1 further comprising a cap hingedly connected to said blade storage compartment.

5. The holster assembly of claim 1 wherein said blade storage compartment is integrally formed with said blade well.

6. A holster assembly for use with a utility knife adapted to hold a segmented blade, said holster assembly comprising:

a holster having a generally hollow interior adapted to receive and hold said utility knife, and a blade well having a hollow interior, said blade well being removably secured inside said hollow interior of said holster, said blade well having a slot therethrough whereby an endmost segment of the knife blade is placed into the slot and the utility knife twisted in order to break off the endmost blade segment, the endmost blade segment falling inside the hollow interior of the blade well wherein said blade well has a blade storage compartment adapted to engage a complementarily configured receptacle integrally formed in said holster to inhibit lateral movement of said blade well inside said generally hollow interior of said holster.

7. The holster assembly of claim 6 wherein said compartment is generally vertically oriented.

8. The holster assembly of claim 6 wherein said blade well has a cap hingedly connected to said compartment.

9. The holster assembly of claim 6 wherein said holster has a clip secured to said holster.

10. The holster assembly of claim 6 further comprising a finger loop secured to said blade well, whereby a user may lift said blade well away from said holster by inserting a finger in said finger loop and pulling said blade well upwardly.

11. A holster assembly adapted to be used with a utility knife having a segmented blade, said holster assembly comprising:

a holster having an open top, a front wall portion, a rear wall portion, a pair of side wall portions and a bottom portion defining a hollow interior of said holster, a disposable blade well removably located inside the hollow interior of the holster, said blade well having at least two slots therethrough, each of said slots being adapted to selectively receive an endmost segment of the utility knife blade whereby an endmost segment of the utility knife blade is inserted into the slot and the utility knife twisted in order to break off the endmost segment of the knife blade, the endmost segment of the knife blade falling inside said blade well, said blade well and said utility knife being removable through said open top of said holster.

12. The holster assembly of claim 11 wherein said blade well has a blade storage compartment integrally formed therein.

13. The holster assembly of claim 12 wherein said blade well has a cap hingedly connected to said blade storage compartment.

14. The holster assembly of claim 11 wherein said blade well has a finger loop to facilitate removal of said blade well from said hollow interior of said holster.

* * * * *